US009803944B2

(12) United States Patent
Pittman et al.

(10) Patent No.: US 9,803,944 B2
(45) Date of Patent: Oct. 31, 2017

(54) GUN SAFETY DEVICE

(71) Applicant: John M. Pittman, St. Albans, ME (US)

(72) Inventors: John M. Pittman, St. Albans, ME (US); Jeremy T. York, Mars Hill, ME (US); Bryan A. Johnson, Madison, ME (US)

(73) Assignee: John M. Pittman, St. Albans, ME (US)

( * ) Notice: Subject to any disclaimer, the term of this patent is extended or adjusted under 35 U.S.C. 154(b) by 0 days.

(21) Appl. No.: 15/326,804

(22) PCT Filed: Mar. 10, 2016

(86) PCT No.: PCT/US2016/021793
§ 371 (c)(1),
(2) Date: Jan. 17, 2017

(87) PCT Pub. No.: WO2016/145209
PCT Pub. Date: Sep. 15, 2016

(65) Prior Publication Data

US 2017/0191774 A1 Jul. 6, 2017

Related U.S. Application Data

(60) Provisional application No. 62/130,768, filed on Mar. 10, 2015, provisional application No. 62/130,716, filed on Mar. 10, 2015.

(51) Int. Cl.
*F41A 17/00* (2006.01)
*F41A 17/44* (2006.01)
*F41A 17/02* (2006.01)

(52) U.S. Cl.
CPC ..... *F41A 17/44* (2013.01); *F41A 17/02* (2013.01)

(58) Field of Classification Search
CPC ..... F41A 17/44; F41A 17/02
(Continued)

(56) References Cited

U.S. PATENT DOCUMENTS 2,327,334 A * 8/1943 Parker ..... F41A 17/44 15/104.16
2,479,107 A * 8/1949 Garretson ..... F41A 17/44 42/70.01

(Continued)

OTHER PUBLICATIONS

International Search Report and Written Opinion for corresponding PCT application PCT/US2016/021793, dated May 17, 2016, 9 pp.

(Continued)

*Primary Examiner* — Samir Abdosh
(74) *Attorney, Agent, or Firm* — Caseiro Burke LLC; Chris A. Caseiro

(57) ABSTRACT

A device for controlling access to a firearm having a muzzle. The device includes a shaft that may be rigid or flexible and a slotted cylinder arranged for retaining the shaft thereto. The cylinder may also be flexible in an embodiment of the invention. The device includes a plurality of components that cooperatively ensure that any form of tampering is resisted so that the firearm remains secure. The device includes a lock housing and a lock foundation, wherein the lock housing is arranged to receive a key. The cylinder and shaft are removably attachable to the lock foundation. The cylinder-shaft combination is arranged for insertion into the muzzle. A gear engaged with the shaft causes movement of the shaft into the cylinder. A collet includes one or more radially displaceable tabs arranged for insertion in slots of the cylinder when the shaft moves through the collet into the cylinder.

28 Claims, 8 Drawing Sheets

(58) Field of Classification Search
USPC ..... 42/70.11
See application file for complete search history.

(56) References Cited

U.S. PATENT DOCUMENTS

| | | | | | |
|---|---|---|---|---|---|
| 2,836,918 | A * | 6/1958 | Pula | F41A 17/44 | 138/89 |
| 3,154,874 | A * | 11/1964 | Stewart | F41A 17/44 | 42/70.11 |
| 3,193,959 | A * | 7/1965 | Jaycox | F41A 17/44 | 42/70.11 |
| 3,710,490 | A * | 1/1973 | Cornett | F41A 17/44 | 42/70.11 |
| 3,765,115 | A * | 10/1973 | Johansson | F41A 17/44 | 42/70.11 |
| 4,512,099 | A * | 4/1985 | Mathew | F41A 17/44 | 42/70.11 |
| 4,777,753 | A | 10/1988 | Stancato | | |
| 5,115,589 | A * | 5/1992 | Shuker | F41A 17/44 | 42/70.11 |
| 5,138,785 | A * | 8/1992 | Paterson | F41A 17/44 | 42/66 |
| 5,239,767 | A | 8/1993 | Briley, Jr. et al. | | |
| 5,241,770 | A * | 9/1993 | Lambert | F41A 17/44 | 42/70.11 |
| 5,289,653 | A * | 3/1994 | Szebeni | F41A 17/44 | 42/70.11 |
| 5,699,687 | A * | 12/1997 | Pittman | F41A 17/02 | 42/70.11 |
| 6,223,566 | B1 | 5/2001 | Jamison | | |
| 6,374,527 | B1 | 4/2002 | Finardi | | |
| 6,560,910 | B1 | 5/2003 | McLaren | | |
| 6,584,718 | B1 * | 7/2003 | Serrao | F41A 17/02 | 42/44 |
| 8,677,672 | B2 | 3/2014 | Kennedy et al. | | |
| 9,222,742 | B2 | 12/2015 | Steuwer et al. | | |
| 2003/0115785 | A1 | 6/2003 | Milo | | |
| 2006/0288624 | A1 | 12/2006 | Ha | | |

OTHER PUBLICATIONS

International Search Report and Written Opinion for PCT application PCT/US2016/027329 of the same applicant, dated Jul. 15, 2016, 7 pp.

* cited by examiner 2030
2021
41

2030
2021
40
41
2010a
2021c

2030

3030
3021
41

3030
3021
40
41
3021c
3010a

3030

3030

GUN SAFETY DEVICE

BACKGROUND OF THE INVENTION

1. Field of the Invention

The present invention relates to devices for gun safety. In particular, the present invention relates to devices that prevent unauthorized use of a gun.

2. Background of the Invention

The present invention is an advancement over the gun safety device described in U.S. Pat. No. 5,699,687 that was issued on Dec. 23, 1997. The entire content of U.S. Pat. No. 5,699,687 is incorporated herein by reference. Improvements have been made to enhance the functionality of the device. Those improvements include the elimination of some components of the original device, the modification of some components of the original device and the addition of new components. The versions of the invention described herein improve overall safety certainty, strengthen structural integrity, improve anti-tampering properties and reduce manufacturing costs.

SUMMARY OF THE INVENTION

Two versions of the present gun safety device are described herein. A first version of the invention is inserted into the muzzle of a gun and has a rigid shaft like the original device. It includes a non-bendable slotted cylinder and a corresponding, non-articulating and one piece shaft within its housing. A second version of the invention is inserted into the muzzle of a gun and has a flexible shaft. It includes a flexible slotted cylinder and a corresponding articulating shaft within its housing. Most, but not all, improvements are to specific components: improving their function, strengthening them and their anti-tamper properties and making them easier and cheaper to produce. A few new components are added. A few components have been eliminated. This device is designed to further self-defend itself and resist tampering and defeat by commonly available means including; brute force, crushing, cutting, drilling, grinding and reverse installation. A goal of the device of the present invention is to damage or destroy, both itself and the firearm, before it is compromised.

The following detailed description, the accompanying drawings and the appended claims will further describe the present invention.

DETAILED DESCRIPTION OF THE INVENTION

Figures 1, 2:
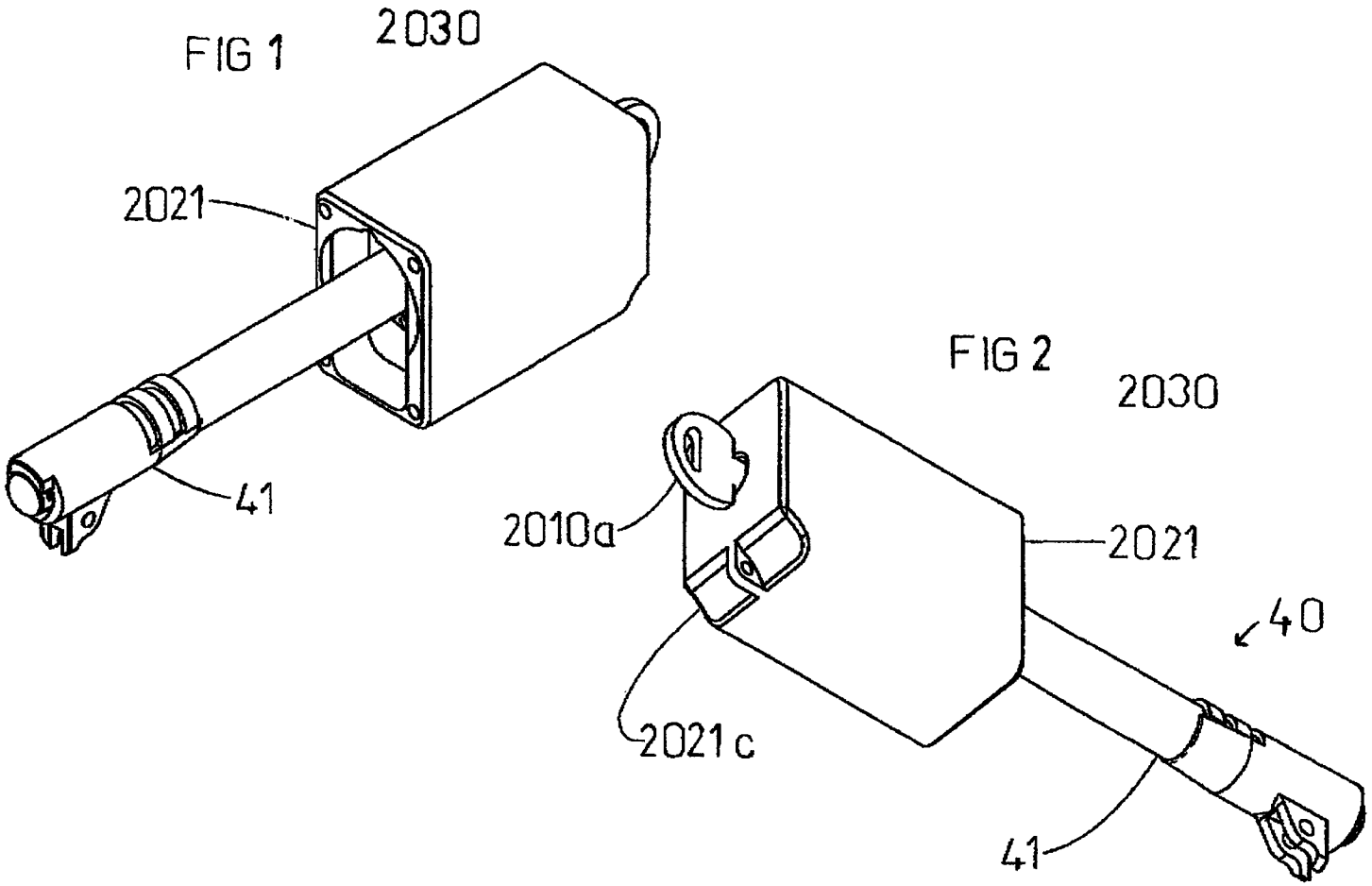
FIG. 1 is a front perspective view of a first embodiment of the firearm safety device of the present invention in a barrel of a gun.
FIG. 2 is a rear perspective view of the present invention shown in FIG. 1.
Figure 3:
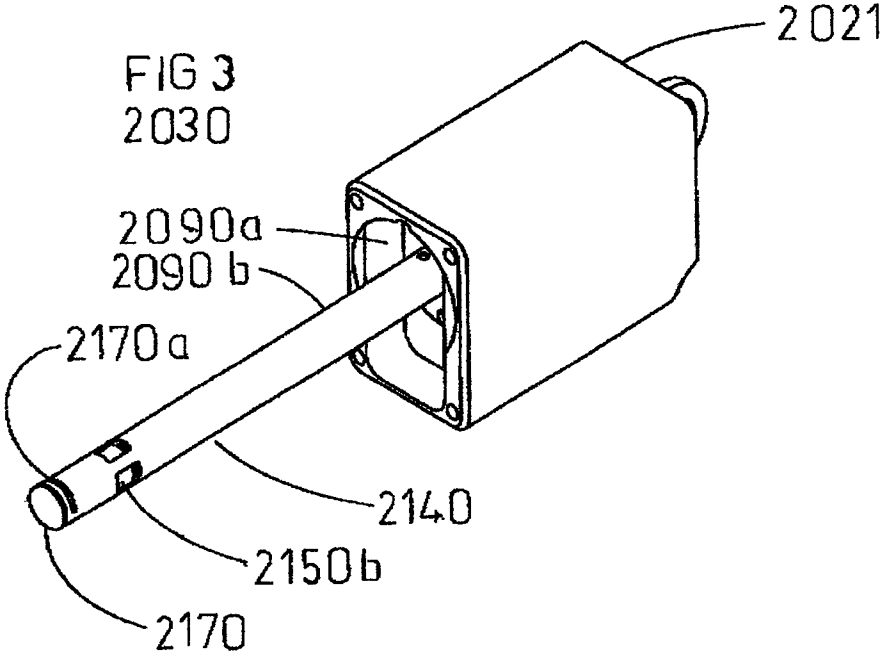
FIG. 3 is a perspective view of the first embodiment of the present invention without the gun barrel.
Figure 4:
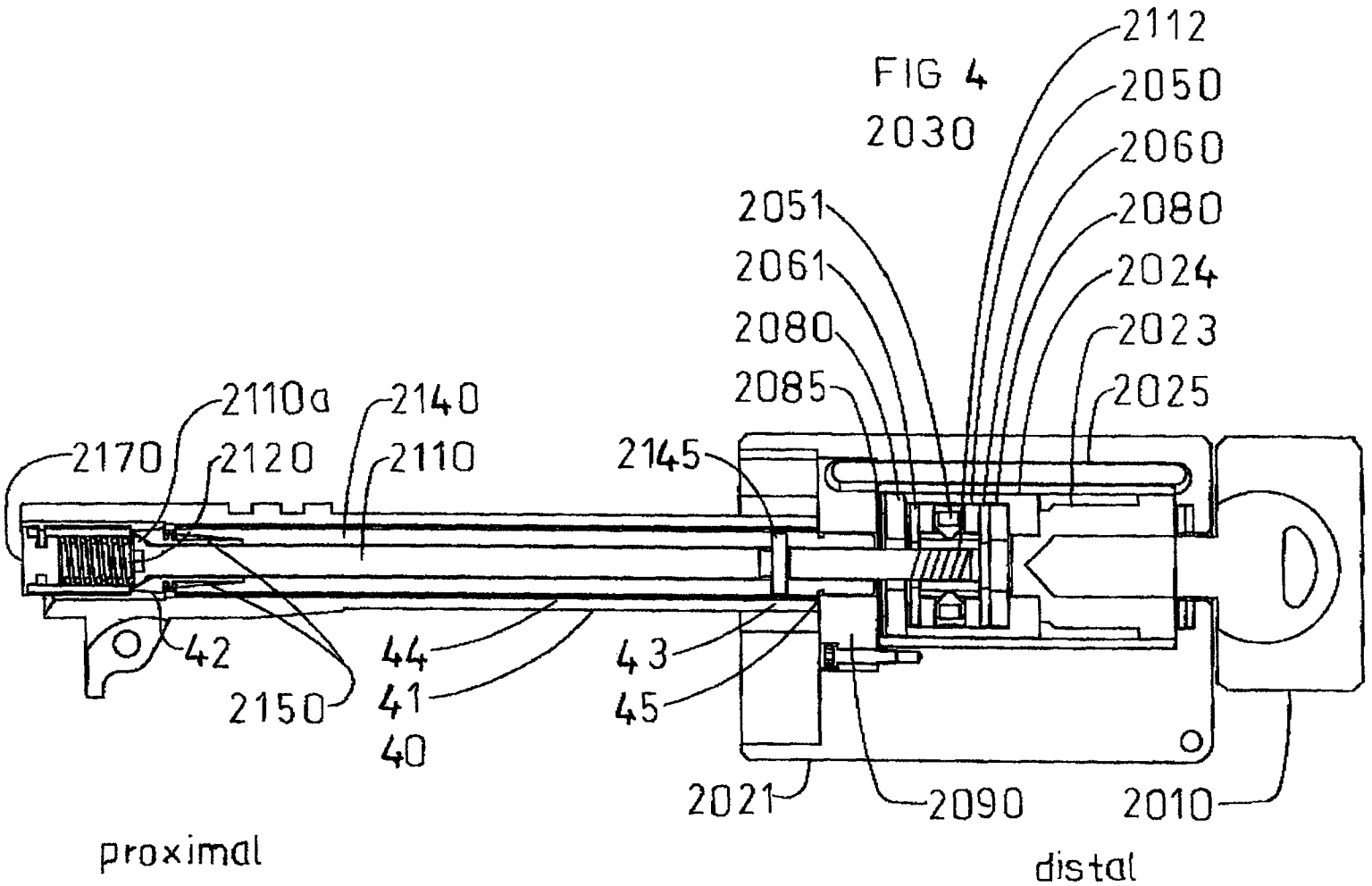
FIG. 4 is a cross sectional side view of the present invention shown in FIG. 1.
Figure 5:
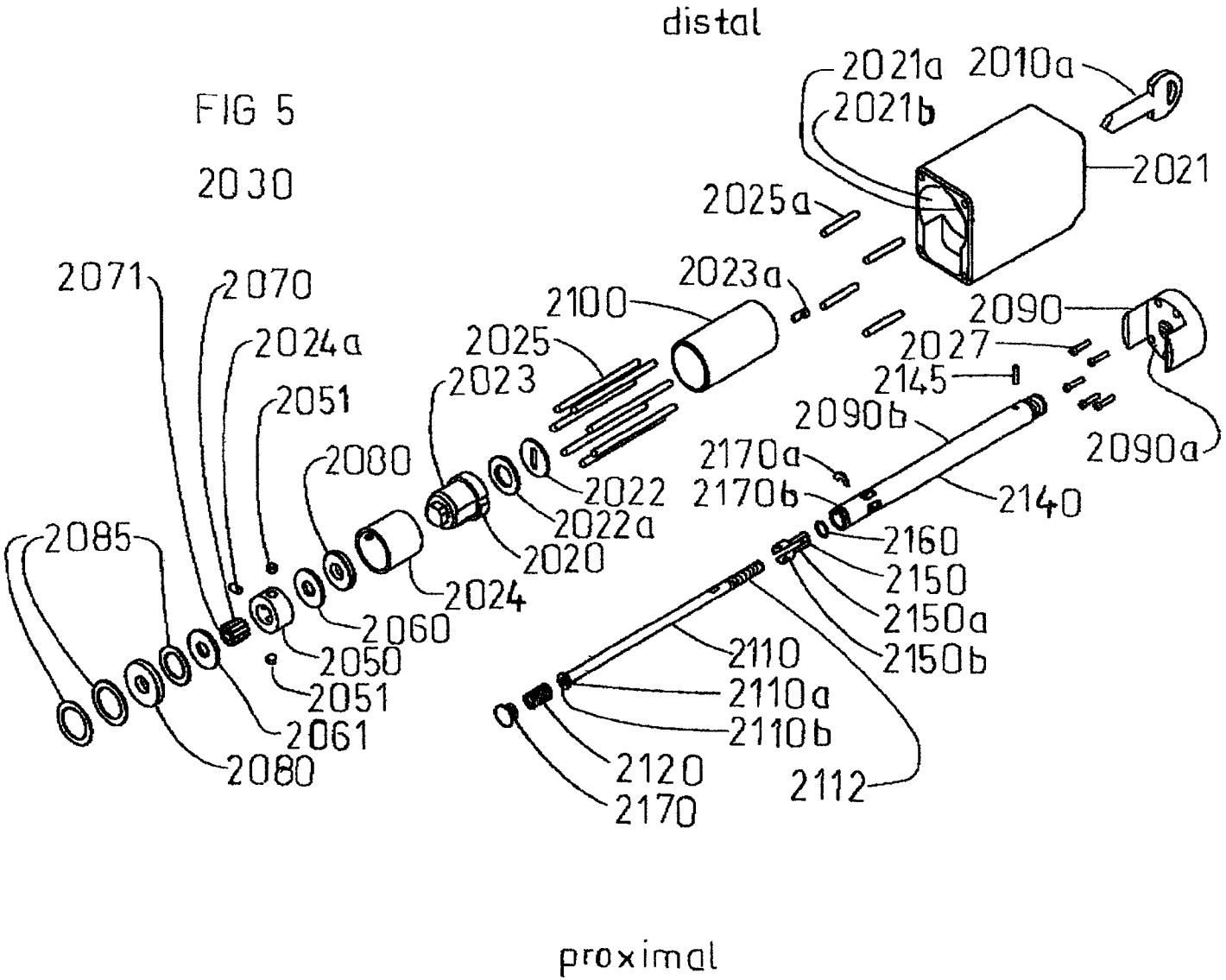
FIG. 5 is an exploded view of the first embodiment of the present invention.

A first gun safety device 2030 of the present invention shown in FIGS. 1-5 is a type of locking mechanism that can be used to prevent firearm operation by preventing ammunition from being chambered and by blocking a barrel 41 of a firearm 40.

The device 2030 includes a proximal end 11 (near the firearm trigger) and a distal end 12 (near the end of the barrel 41). A key structure 2010 including key 2010*a* renders the device 2030 enabled and disabled via a lock 2020. The lock 2020 type shown is a wafer-tumbler lock mechanism, however any suitable type of lock may be used. The lock 2020 includes a tumbler 2023 and one or more pins 2025, preferably made of steel or other suitable high strength noncorrosive metal, or a rigid plastic. The pins 2025 occupy parallel axial holes 2021*a* drilled in an interior surface 2021*b* of a lock housing 2021. The lock housing 2021 is joined with a lock foundation 2090. The lock housing 2021 may optionally include a modification to enable removable attachment of a lanyard 2021*c*, for example. The modification may be a cave-like structure machined into the lock housing 2021, drilling and press fitting a shallow U-shaped component into the body of the housing 2021 or by other means.

A lock stop 2023*a* anchors the tumbler 2023 within the lock housing 2021 and prevents the tumbler 2023 from rotating within the lock housing 2021. The pins 2025 are freely rotatable in both clockwise and counter-clockwise directions. The number of pins 2025 and related axial holes 2021*a* employed may vary, as determined by the circumference of the lock housing 2021 and complete circumferential protection of internal components housed within the lock housing 2021. There may be four or more such pins 2025. An additional set of rotating pins 2025*a* are included circumferentially around the pins 2025 to protect the cavity where muzzle 43 is enshrouded and to enhance anti-tampering.

The lock housing 2021 and the lock foundation 2090 are secured together with one or more foundation access screws 2027 counterbored into the lock foundation 2090 where they are not accessible; that is, they are hidden, so as to provide an added barrier against tampering. To gain access to internal components of the device 2030 while the device 2030 is disengaged from the firearm 40, the foundation access screws 2027 must be removed and then the lock housing 2021 disengaged from the foundation 2090. The use of the combination of the lock housing 2021 with the foundation 2090 and its foundation access screws 2027 ensures that a miscreant has no obvious starting point for defeating the device 2030. These hidden screws, which may be made of a material with high structural integrity, such as stainless steel, and their shafts may be covered with small, superimposed and bi-directionally rotating bushings to further enhance internal anti-tampering.

A lock cam 2024 is provided which rotates upon rotation of key 2010*a* during locking and unlocking procedures. Key 2010*a* may be of a standard type (as shown), designed to be removed to allow the device 2030 to be maintained in a locked or unlocked position without the insertion of a key. Alternatively, the key structure 2010 may be a safety type (as shown), designed to be kept in place within the lock housing 2021 so that a user of the invention may maintain the device 2030 in a locked position, while also being able to quickly unlock the device 2030 without re-insertion of the key 2010*a*.

In a locking mode of operation, the device 2030 is locked by the insertion of the key 2010*a* through slotted disk 2022 and support disk 2022*a* and into lock cam 2024 which freely rotates during key rotation. Initially, slotted cylinder 2140 is inserted through the muzzle 43 of the firearm 40. The slotted cylinder 2140 is designed to be of a length sufficient to extend from the given firearm's muzzle 43 through bore 44 of the barrel 41 and into the chamber aligned with the barrel 41. Dimensions may be altered to suit each given type of firearm without departing from the scope of the invention. The slotted cylinder 2140 is configured such that its distal end (nearest to the end of the barrel 41) is threaded and arranged for removable attachment to the lock foundation 2090 by screwing into matching threading within the lock foundation 2090. The slotted cylinder 2140 is formed of a rigid, non-corrodible and non-bendable material, such as rigid aluminum tubing or a stainless steel, that when covered will not damage the barrel 41 or bore 44. The slotted cylinder 2140 and shaft 2110 may be swapped in that they may be removed and replaced with shorter or longer components and/or dimensions to be customizable to the dimensions of a particular firearm.

Upon clockwise rotation of lock cam 2024, annulus 2050 rotates in a clockwise direction. Spring-loaded wedges 2051, which are placed on the inner surface of the annulus 2050, force the annulus 2050 over a bi-directional slip gear 2070 during lock cam 2024 rotation. The gear 2070 may be of a modified ratchet configuration. The annulus 2050 is rotationally fixed within lock cam 2024 and is fastened in place by a small post 2024*a* between the annulus 2050, the lock cam 2024 and large bidirectionally rotating bushing 2100. Gear 2070 may be machined from a single piece or consist of separate parts fastened together. Distal disk 2060 and proximal disk 2061 freely rotate and increase self-defense capability and provide increased internal lateral support and bolster anti-tampering against crushing.

The aforementioned components 2020, 2022, 2022*a*, 2023, 2024, 2025, 2050, 2051, 2024*a*, 2060, 2061, 2070, 2080 and 2085 are held within the lock housing 2021 by the lock foundation 2090. The lock housing 2021 and the lock foundation 2090 are preferably manufactured to accept and to shelter the muzzle 43 and the region of the firearm 40 in the vicinity of the muzzle 43. A cushion 2090*a* is placed upon the exposed area of lock foundation 2090 as well as the proximal 11 region of the lock housing 2021. The cushion 2090*a* is relatively soft, compressible, substantially porous but not entirely, hydrophobic and may be bonded or applied in place. The cushion 2090*a* is replaceable and covers the union of lock foundation 2090 and muzzle 43 when the device 2030 is in use to protect the finish of the firearm 40 and prevent any slippage at the union. The cushion 2090*a* fully lines the interior of the cavity that accepts the muzzle 43 and shelters the muzzle 43 like a glove. The configuration of the 'shelter' may take two forms; first a "generic" form that will accept any firearm having outside muzzle vicinity dimensions are less than the internal dimensions of the cavity and second a "model specific" form that conforms to and will only accept a specific model of firearm. The cross sectional shape of the lock housing 2021 that serves firearms with components of circular cross section, may also be round but is not limited thereto. For example, the cross sectional shape of the lock housing 2021 that serves firearms with non-round shapes, such as in the area of the muzzle, may be of a corresponding non-round shape. The cushion 2090*a* is configured such that it may hide the foundation screws 2027 as well as the union between the lock housing 2021 and the lock foundation 2090. The cushion 2090*a* may extend over the entire length of the slotted cylinder 2140 such as in the form of a sleeve 2090*b*. In total, this cushion 2090*a* and sleeve 2090*b* configuration, unlike its original counterpart device, protects the lock housing 2021 the entire length of the slotted cylinder 2140 and the entire internal length of the bore of the barrel 44 and chamber 42.

Although one particular muzzle design is shown, it is to be understood that various muzzle designs may utilize the instant invention. Accordingly, it is within the scope of the invention that the particular shape of lock housing 2021 and lock foundation 2090 may be altered as needed to conform to any given muzzle design without straying from the instant invention's feature of sheltering the muzzle 43. Mounted on the proximal end of the slotted cylinder 2140 is a chamber plug 2170 which is freely rotatable about the proximal end 11 and serves to fully occupy the remainder of the firearm's chamber. The chamber plug 2170 enjoys bi-directional rotational freedom of movement, serves to fully occupy the firearm's chamber as an anti-tamper means. The chamber plug 2170 is retained in position with a chamber plug clip 2170*a* that is flat and semi-circular. The chamber plug clip 2170*a* is located in a perpendicular cut 2170*b* into and half way through the slotted cylinder 2140. This press fitted clip 2170*a*, which is removable and replaceable, fastens and holds the chamber plug 2170 in place. Sleeve 2090*b* further described herein retains the chamber plug clip 2170*a* in place. An alternative chamber plug retention configuration provides a chamber plug shaft residing within a foundation of the chamber plug, which is externally threaded and is mated and screwed into corresponding threading upon and within the proximal terminus of the slotted cylinder 2140.

Gear 2070 is rotatable in both clockwise and counter-clockwise directions. Through the center of gear 2070 is a threaded axial hole 2071. The threaded axial hole 2071 is in mating relation to a threaded distal region 2112 of the shaft 2110. During locking mode, gear 2070 rotates clockwise and pulls the threaded distal region 2112 of the shaft 2110 through the threaded axial hole 2071 of the gear 2070. Bushing 2100 rotates bidirectionally and is enlarged relative to an original component of the prior device such that it internally protects the entire cavity 2021*b* of the device 2030 and all of the components within the lock housing 2021, cooperating with and bolstering the protective cage-like structure of the collection of pins 2025 and 2025*a* and disks 2022, 2022*a*, 2060 and 2061. It is made of a very hard and non-corrodible material such as stainless steel, for example. The benefit of this configuration is a much stronger and tamper resistant shaft 2110 with much more cross sectional material along its entire length. This makes the device 2030 more resistant to tampering with brute force. The clockwise rotation of key structure 2010 or key 2010*a* causes shaft 2110 to retract within the cylinder 2140 towards lock housing 2021.

The shaft 2110 of the device 2030 possesses a displacement region 2110*a* at its proximal terminus which is distally oriented, and may be either conical, pyramidal, cylindrical with a convex terminus, wedge shaped or round shaped. It possesses an indentation at its proximal terminus that avails the shaft 2110 to manipulation with a tool. Its terminus is drawn distally toward the end of the barrel with clockwise turning of key structure 2010 and key 2010*a*. The displacement region 2110*a* on the shaft 2110 penetrates a collet 2150 that possesses a plurality of distally located arms 2150*a* that are oriented proximally, each with a radially proximal and displaceable tab 2150*b* that correspond to similarly shaped slots in the superimposing slotted cylinder 2140. This collet 2150 resembles a small bushing, with a plurality of near longitudinal cuts beginning on its proximal terminus and proceeding distally. On its proximal and dorsal surface are radially oriented tabs 2150*b*. Material between these tabs 2150*b* may be removed or cut out. The tabs 2150*b* may be chamfered on their distal margins to accommodate firearm forcing cones. The displacement region 2110*a* on the shaft 2110 radially forces the tabs 2150*b* outwardly until secure contact with the firearms cartridge case rim is made. This collet 2150 may consist of one or more components and possesses a proximally oriented pivotal ability at its distal terminus. This component 2150 may be fastened in place by a wedge configuration or by mutual threading within the interior of the proximal end of the slotted cylinder 2140. This component may consist of a steel with elastic-like properties. This collet 2150 may possess a circular spring-like component 2160 located circumferentially over the arms 2150*a*, that is a backup mechanism to assure complete tab retraction. Diametrically and circumferentially opposed sets of cams 150 and 160 located at whorls of the original device improved hereby have been eliminated.

It is noted that the cushion 2090*a* and the sleeve 2090*b* in combination all are located at or near the crown 45 of the firearm 40 and may be bolstered by additional layers of material of the sleeve 2090*b*. It is important to protect the crown 45 as it largely determines the accuracy of the firearm. It is located at the very end of the barrel, where the rifling ends. It is where the exiting bullet has its last physical contact with the barrel and its rifling, as it goes on its way. The cushion 2090*a* and the sleeve 2090*b* in the vicinity of crown 45 increase the protection of this region of the firearm 40. It also stabilizes the mating between the device 2030 and the firearm by eliminating gaps, looseness and slippage between the device 2030 and the firearm 40 in this important region. Shim 2085 may also be used to eliminate operational looseness and reduce the risk of mechanical binding within the lock housing 2021 and among its components.

Tabs 2150*b* wedge themselves against the inner surface of the firearm chamber and proximal of the firearm forcing cone until no further movement of shaft 2110 is possible. At this point, spring loaded-wedge 2051 on annulus 2050 slips on gear 2070. This slippage is audible to the user of the locking device 2030 in the form of a clicking noise. The clicking indicates to the user that the locking procedure is complete. This slip-gear arrangement protects both the firearm 40 and the device 2030 from damage during activation or de-activation of the device as it eliminates excessive torque from damaging the internal components of the device 2030 as well as the interior surfaces of the firearm 40. A fastening, removable and replaceable wedge 2145 is arranged to pass through both the slotted cylinder 2140 and the shaft 2110 simultaneously. The wedge 2145 may be press fitted in place. The wedge 2145 enables synchronous movement between the slotted cylinder 2140 and the shaft 2100. It also prevents mechanical binding of the cylinder 2140, the shaft 2110 or both to the tabs 2150*b* on the collet 2150. A similar wedge may also be used to fasten distally the collet 2150 in place within the proximity of the slotted cylinder 2140.

Once the device 2030 is engaged in the firearm 40, it remains in place in a locked position upon removal of key structure 2010 or key 2010*a*. In an unlocking mode of operation, the device 2030 is unlocked by the re-insertion of key structure 2010 or key 2010*a* through slotted disk 2022 and support disk 2022*a* application of a counter-clockwise rotation. Upon counter-clockwise rotation of lock cam 2024, annulus 2050 rotates in a counter-clockwise direction over gear 2070. The gear 2070 rotates counter-clockwise and pushes the threaded distal region 2112 of shaft 2110 through the threaded axial hole 2071 of the gear 2070. Thus, the counter-clockwise rotation of key structure 2010 or key 2010*a* causes shaft 2110 to expand into cylinder 2140 away from lock housing 2021.

Upon linear movement of shaft 2110 away from lock housing 2021, the displacement region 2110*a*, which may be a flange of the shaft 2110, migrates proximally until the tabs 2150*b* located on dorsal and proximal surfaces of the collet 2150 fully retract back into the slotted cylinder 2140 at the urging of the elastic or spring-like properties of the metal employed in making the tabs 2150*b* and/or at the urging of the spring 2160. Adjoining the proximal terminus of the shaft 2110 is a compression spring 2120 configuration that provides enough distally oriented resistance so as no further axial movement of the shaft 2110 is possible. At this point, wedge 2051 on annulus 2050 slips on gear 2070. As during locking, this slippage is audible to the user of the locking device 2030 in the form of a clicking noise. Here, the clicking indicates to the user that the unlocking procedure is complete. Accordingly, the device 2030 is free to be pulled out of the firearm chamber 42 and barrel 41 by the user. Again, this arrangement protects against damage to the device 2030 and the firearm 40 during operation.

An additional element in accordance with this invention is a pyric disk 2080. The pyric disk 2080 is freely rotatable and is located between lock foundation 2090 and proximal disk 2061. The pyric disk 2080 may be comprised of one or more such disks and the location of pyric disk 2080 is chosen to be near the gear 2070, most suitably the section including the threaded distal region 2112 of shaft 2110. The pyric disk 2080 is manufactured of a solder-like material that will melt when exposed to extreme heat as well as friction-related heat generated by cutting with a saw, drilling and grinding. The solder-like material should be a metal that has a melting point at least as high as the temperature commonly attained by blow-torches. The effect is to cause shaft 2110 and other internal components to be seized in place. Gaps between the shaft 2110 and other adjacent components enables molten material of melted pyric disk 2080 to migrate throughout the invention. This design, which allows molten material to migrate into the firearm, may be utilized to further dissuade unauthorized users from tampering with a firearm utilizing such an alternative design of the instant invention. It should be clear that such an alternative design is well within the scope of the present invention. Thus, pyric disk 2080 is designed as a mechanism to protect against tampering via devices such as an acetylene torch.

A compression spring 2120 is shown at the proximal end of shaft 2110 and is distally located adjacent to the chamber plug 2170. Compression spring 2120 places a constant axial force on the shaft 2110 in the direction towards the distal end 12. This force is countered by the presence of the lock mechanism 2020. In the event of tampering which severs the lock housing 2010 or the lock mechanism 2020 from the remainder of the device 2030, spring 2120 will maintain the tabs 2150*b* on the collet 2150 in a wedged position.

Figures 6, 7:
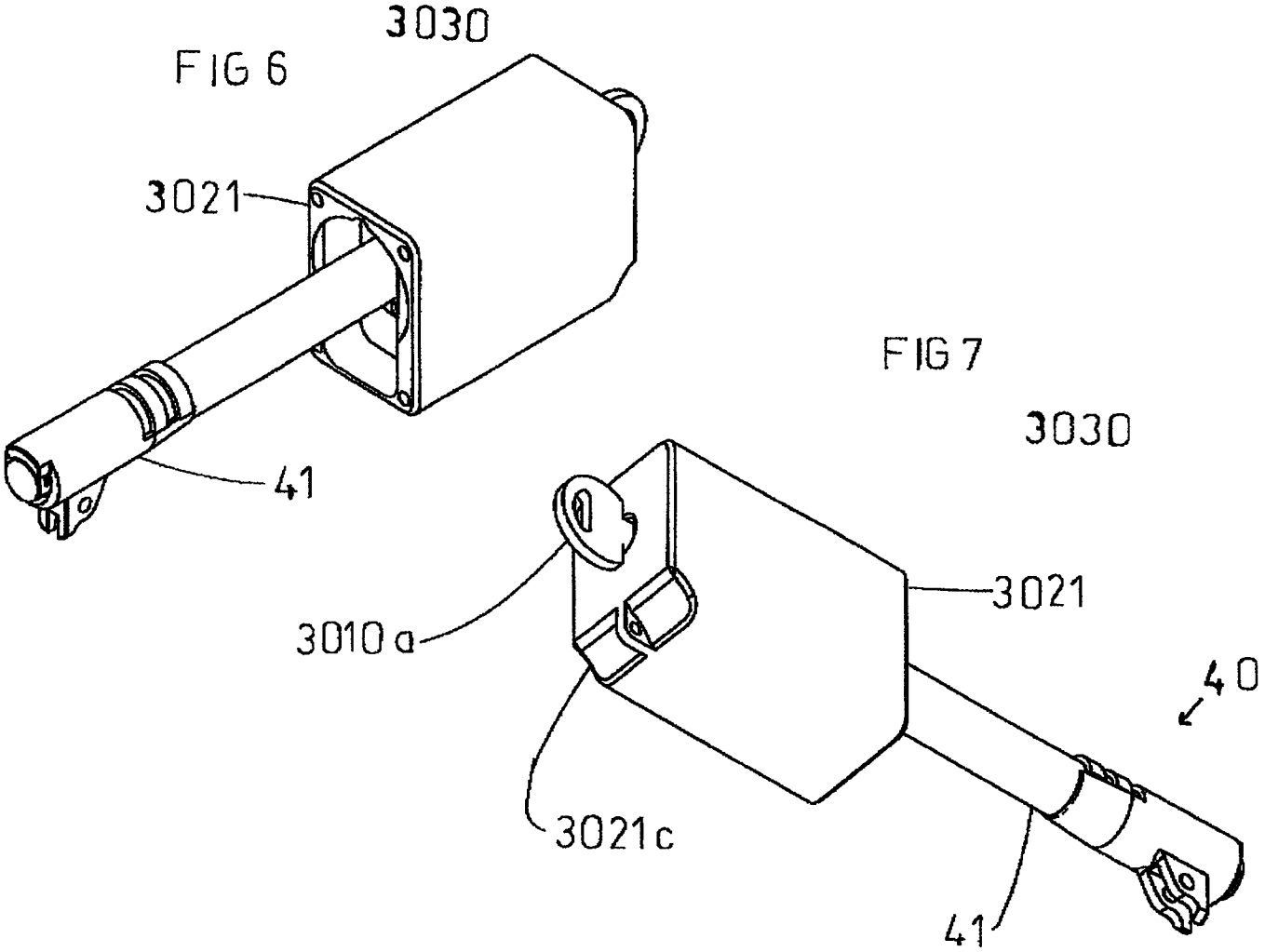
FIG. 6 is a front perspective view of a second embodiment of the firearm safety device of the present invention in a barrel of a gun.
FIG. 7 is a rear perspective view of the present invention shown in FIG. 6.
Figure 8:
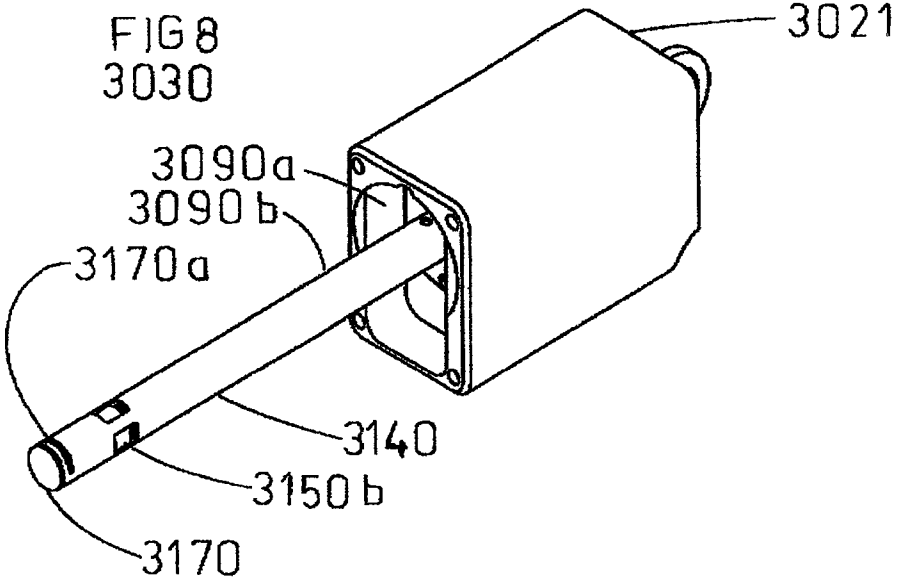
FIG. 8 is a perspective view of the second embodiment of the present invention without the gun barrel.
Figure 9:
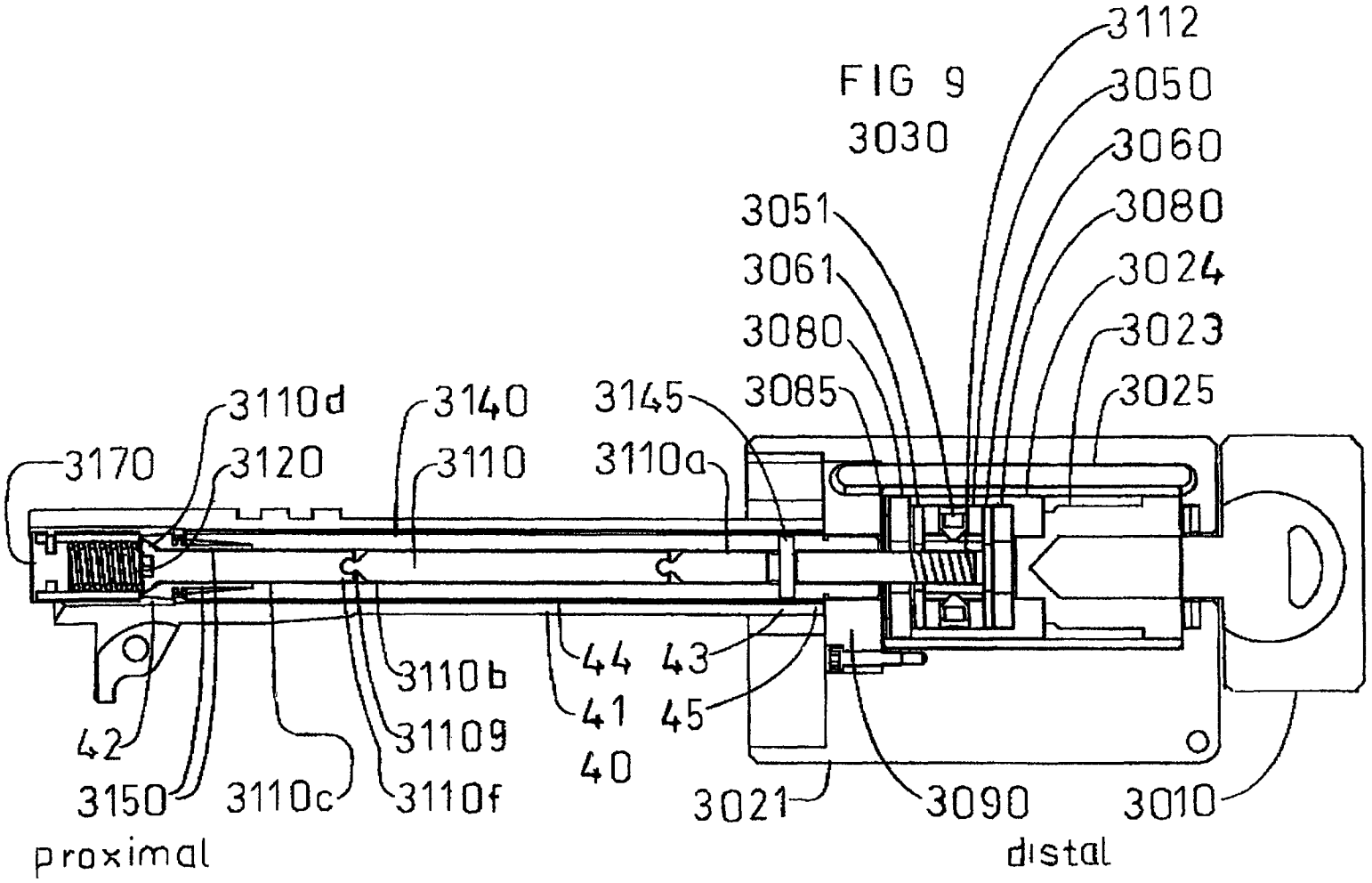
FIG. 9 is a cross sectional side view of the present invention shown in FIG. 6.
Figure 10:
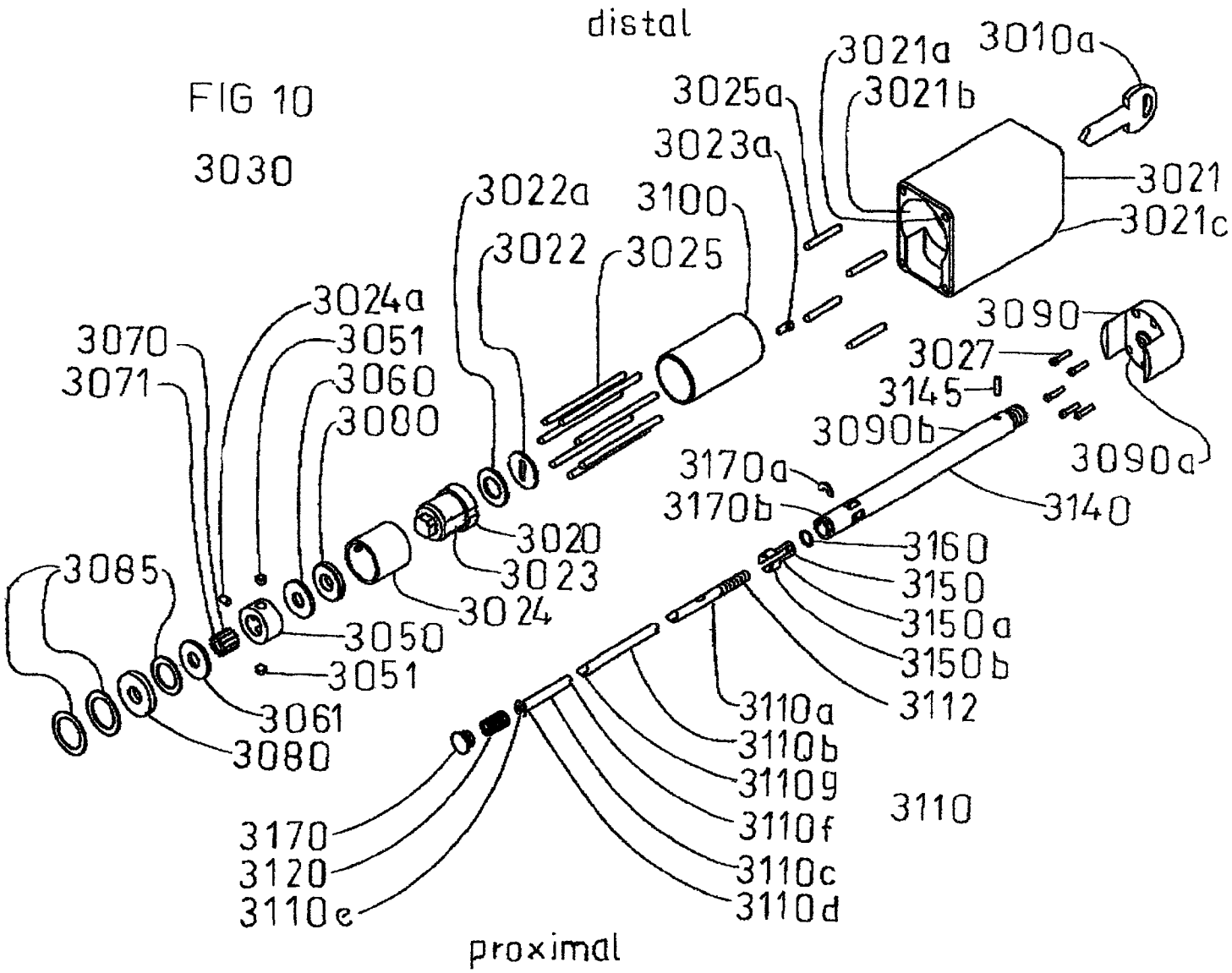
FIG. 10 is an exploded view of the second embodiment of the present invention.

A second gun safety device 3030 of the present invention shown in FIGS. 6-10 is a type of locking mechanism that can also be used to prevent firearm operation by preventing ammunition from being chambered and by blocking the barrel 41 of the firearm 40. Those components of the gun safety device 3030 that correspond to the same components of the first gun safety device 30 will be identified with similar element numbers. The device 3030 includes a lock foundation 3090, a flexible slotted cylinder 3140 and a flexible shaft 3110. It may also include a chamber plug 3170 of a distinct configuration, among other components.

The device 3030 includes a proximal end 11 (near the firearm trigger) and a distal end 12 (near the end of the barrel 41). A key structure 3010 including key 3010*a* renders the device 3030 enabled and disabled via a lock 3020. The lock 3020 type shown is a wafer-tumbler lock mechanism, however any suitable type of lock may be used. The lock 3020 includes a tumbler 3023 and one or more pins 3025, preferably made of steel or other suitable high strength noncorrosive metal, or a rigid plastic. The pins 3025 occupy parallel axial holes 3021*a* drilled in interior surface 3021*b* of a lock housing 3021. The lock housing 3021 is joined with the lock foundation 3090. The lock housing 3021 may optionally include a modification to enable removable attachment of a lanyard 3021*c*, for example. The modification may be a cave-like structure machined into the lock housing 3021, drilling and press fitting a shallow U-shaped component into the body of the housing 3021 or by another means.

A lock stop 3023*a* anchors the tumbler 3023 within the lock housing 3021 and prevents the tumbler 3023 from rotating within the lock housing 3021. The pins 3025 are freely rotatable in both clockwise and counter-clockwise directions. The number of pins 3025 and related axial holes 3021*a* employed may vary, as determined by the circumference of the lock housing 3021 and complete circumferential protection of internal components housed within the lock housing 3021. There may be four or more such pins 3025. An additional set of rotating pins 3025*a* are included circumferentially around the pins 3025 to protect the cavity where the muzzle 43 is enshrouded and to enhance anti-tampering.

The lock housing 3021 and the lock foundation 3090 are secured together with one or more foundation access screws 3027 counterbored into the lock foundation 3090 where they are not accessible; that is, they are hidden, so as to provide an added barrier against tampering. To gain access to internal components of the device 3030 while the device 3030 is disengaged from the firearm 40, the foundation access screws 3027 must be removed and then the lock housing 3021 disengaged from the lock foundation 3090. The use of the combination of the lock housing 3021 with the foundation 3090 and its foundation access screws 3027 ensures that a miscreant has no obvious starting point for defeating the device 3030. These hidden screws 3027, which may be made of a material with high structural integrity, such as stainless steel, and their shafts may be covered with small, superimposed and bi-directionally rotating bushings to further enhance internal anti-tampering.

Slotted cylinder 3140 is configured such that its distal end (nearest to the end of the firearm barrel) is threaded and arranged for removable attachment to the lock foundation 3090 by screwing it into matching threading within the lock foundation 3090. Alternatively, the lock foundation 3090 is machined or otherwise modified to include an internal retention receptacle that is cone shaped and oriented proximally toward the chamber plug 3170. A similar hollow retention component that is complementary, cone shaped and slightly smaller than retention receptacle, but with the same shape and depth of it may be used. The retention component possesses barbs, raised edges or knurling on its exterior surface to grasp and secure flexible slotted cylinder 3140 in place. Both are press fitted and or bonded or otherwise affixed in the lock foundation retention receptacle. The cylinder 3140 is formed of a flexible material, such as a non-metallic material. It may be a plastic tubing, for example, including, but not limited to, Nylon, polyolefin, fluoropolymer or other high-performance material. It may also be made of a composite material including but not limited to carbon fiber, high modulus graphite and high modulus boron/graphite. The low friction tubing may alternatively be braided steel tubing, segmented steel tubing or a small outside diameter hydraulic hose. All may be covered by a heat shrink plastic tubing 3090*b* over their entire length upon the slotted cylinder 3140. The covering materials are selected to be soft enough to not damage the internal surfaces of a firearm's barrel and chamber; yet strong enough to protect the shaft 3110. This configuration will simultaneously protect the entire lengths of the slotted cylinder 3140 and the shaft 3110, the bore 44 of the barrel 41 and the chamber 42. Due to the flexibility and low friction texture of its external surface established by using low friction materials, the security device 3030 can be withdrawn from a firearm more quickly.

A lock cam 3024 is provided which rotates upon rotation of key 3010*a* during locking and unlocking procedures. Key 3010*a* may be of a standard type (as shown), designed to be removed to allow the device 3030 to be maintained in a locked or unlocked position without the insertion of a key. Alternatively, key structure 3010 may be a safety type (as shown), designed to be kept in place within the lock housing 3021 so that a user of the invention may maintain the device 3030 in a locked position, while also being able to quickly unlock the device 3030 without re-insertion of the key.

In a locking mode of operation, the device 3030 is locked by the insertion of the key 3010*a* through slotted disk 3022 and support disk 3022*a* and into lock cam 3024, which freely rotates during key rotation. Initially, slotted cylinder 3140 is inserted through the muzzle 43 of the firearm 40. The slotted cylinder 3140 is designed to be of a length sufficient to extend from the given firearm's muzzle 43 through the bore 44 of the barrel 41 and into the chamber 42 aligned with the barrel 41. Dimensions may be altered to suit each given type of firearm without departing from the scope of the invention. The slotted cylinder 3140, when covered, will not damage the barrel 41 or the bore 44. The slotted cylinder 3140 and the shaft 3110 may be swappable in that they may be removed and replaced with shorter or longer components dependent upon the particular dimensions of the firearm with which the device 3030 is to be used.

Upon clockwise rotation of lock cam 3024, annulus 3050 rotates in a clockwise direction. Spring-loaded wedges 3051, which are placed on the inner surface of the annulus 3050, force the annulus 3050 over a bi-directional slip gear 3070 during rotation of the lock cam 3024. The gear 3070 may be of a modified ratchet configuration. The annulus 3050 is rotationally fixed within lock cam 3024 and is fastened in place by a small post 3024*a* between the annulus 3050, the lock cam 3024 and large bidirectionally rotating bushing 3100. Gear 3070 may be machined from a single piece or consist of separate parts fastened together. Distal disk 3060 and proximal disk 3061 freely rotate and increase self-defense capability and provide increased internal lateral support and bolster anti-tampering against crushing.

The aforementioned components 3020, 3022, 3022*a*, 3023, 3024, 3024*a*, 3025, 3050, 3051, 3060, 3061, 3070, 3080 and 3085 are held within the lock housing 3021 by the lock foundation 3090. The lock housing 3021 and the lock foundation 3090 are preferably manufactured to accept and to shelter the muzzle 43 and the region of the firearm 40 in the vicinity of the muzzle 43. A cushion 3090*a* is placed upon the exposed area of the lock foundation 3090 as well as the proximal region of the lock housing 3021. The cushion 3090*a* is relatively soft, compressible, almost porous, hydrophobic and may be glued on or sprayed in place. The cushion 3090*a* is replaceable and covers the union of lock foundation 3090 and muzzle 43 when the device 3030 is in use to protect the finish of the firearm 40 and prevent any slippage at the union. The cushion 3090*a* fully lines the interior of the cavity that accepts the muzzle 43 like a glove. The configuration of the 'shelter' may take two forms; first a "generic" form that will accept any firearm having outside muzzle vicinity dimensions are less than the internal dimensions of the cavity and second a "model specific" form that conforms to and will accept a specific model of firearm. The cross sectional shape of the lock housing 3021 that serves firearms with components of circular cross section, may also be round but is not limited thereto. For example, the cross sectional shape of the lock housing 3021 that serves firearms with non-round shapes, such as in the area of the muzzle, may be of a corresponding non-round shape. The cushion 3090*a* is configured such that it may hide the foundation screw 3027 as well as the union between the lock housing 3021 and the lock foundation 3090. The cushion 3090*a* may extend over the entire length of the flexible slotted cylinder 3140 such as in the form of a sleeve. In total, this cushion 3090*a* and sleeve 3090*b* configuration, unlike its original counterpart device, protects the lock housing 3021 the entire length of the slotted cylinder 3140 and the entire internal length of the bore 44 and the chamber 42.

Although one particular muzzle design is shown, it is to be understood that various muzzle designs may utilize the instant invention. Accordingly, it is within the scope of the invention that the particular shape of lock housing 3021 and lock foundation 3090 may be altered as needed to conform to any given muzzle design without straying from the instant invention's feature of sheltering the muzzle 43. Mounted on the proximal end of the slotted cylinder 3140 is the chamber plug 3170, which is freely rotatable about the proximal end and serves to fully occupy the remainder of the firearm's chamber 42. The chamber plug 3170 enjoys bi-directional rotational freedom of movement, serves to fully occupy the firearm's chamber as an anti-tamper means. The chamber plug 3170 is retained in position with a chamber plug clip 3170*a* that is flat and semi-circular. The chamber plug clip 3170*a* is located in a perpendicular cut 3170*b* into and half way through the slotted cylinder 3140. This press fitted clip 3170*a*, which is removable and replaceable, fastens and holds the chamber plug 3170 in place. Sleeve 3090*b* further described herein retains the chamber plug clip 3170*a* in place. Alternatively, the chamber plug 3170 may be distinct from the chamber plug 2170 of the first device 2030 in that it may be fastened in place within a chamber plug foundation by crimping with a crimping component. In this alternative, the chamber plug 3170 includes a shaft thereon that mates within a matching plug foundation component. The foundation component includes a fastening system that receives and houses the shaft. The shaft has barbed and or raised edges or knurling on its exterior surface to grasp and secure with the internal surface of the flexible slotted cylinder 3140 and are located within the proximal terminus of the flexible slotted cylinder 3140 then crimped into place. The crimping component fastens the chamber plug foundation component with the chamber plug 3170 within and flexible slotted cylinder 3140 in place simultaneously. The crimping component is removable and may be a replaceable band or other fastening means. An alternative plug retainer may have a chamber plug shaft residing within the chamber plug foundation, which is externally threaded and is mated and screwed into mutual threading upon and within the proximal terminus of the slotted cylinder 3110.

Gear 3070 is rotatable in both clockwise and counterclockwise directions. Through the center of gear 3070 is a threaded axial hole 3071. The threaded axial hole 3071 is in mating relation to a threaded distal region 3112 of shaft 3110. During locking mode, gear 3070 rotates clockwise and pulls the threaded distal region 3112 of the shaft 3110 through the threaded axial hole 3071 of the gear 3070. Bushing 3100 rotates bidirectionally and is enlarged relative to an original component of the prior device such that it internally protects the entire cavity of the device 3030 and all of the components within the lock housing 3021, cooperating with and bolstering the protective cage-like structure of the collection of pins 3025 and 3025*a* and disks 3022, 3022*a*, 3060 and 3061. It is made of a very hard and non-corrodible material such as stainless steel, for example. The clockwise rotation of key structure 3010 or key 3010*a* causes shaft 3110 to retract within the cylinder 3140 towards lock housing 3021.

The shaft 3110 of the device 3030 is an articulating shaft made up of a plurality of interconnected components (3110*a*, 3110*b* and 3110*c*). The distal end of shaft section 3110*a* is threaded to retain the above mentioned slip gear 3070. The proximal end of shaft section 3110*c* terminates with displacement region 3110*d* engaged with the chamber plug 3170 via spring 3120. The distal end of shaft section 3110*b* and the distal end of shaft section 3110*c* each includes a machined port 3110*f* with proximal and transverse slots that may extend across the diameter of the component in both 0 and 180 degree and 90 and/or 270 degree orientations. These transverse slots that extend proximally as part of this machined port 3110*f* may be inwardly sloped, providing a pivot means of the articulating shaft 3110. Each of the proximal end of shaft section 3110*a* and the proximal end of shaft section 3110*b* include a terminus 3110*g* that is shaped to fit in the machined port 3110*f* of the adjacent shaft section 3110*b* and 3110*c*. That shape of the terminus 3110*g* may be wedge shaped, a spherical terminus or a post-like with a globular terminus, for example. The termini of the two options occupy and are enslaved within the machined ports 3110*f* and are configured by their shape to flex within their machined ports 3110*f*. The machined ports 3110*f* of shaft sections 3110*b* and 3110*c* act as female ports for receiving the termini 3110*g* of shaft sections 3110*a* and 3110*b*, respectively, and are configured to allow for articulated movement of each shaft section so that the shaft 3110 is flexible. Depending on the firearm and the length of its barrel, there may be more than two such components fastened together. The most proximal component of the flexible shaft section 3110*c* cooperates with the above mentioned chamber plug configuration and cooperates with a compression spring 3120 as an anti-tamper means. This multi-component shaft 3110 is manufactured of a very hard and non-corrodible material, such as a stainless steel. Directionality of articulation of the shaft 3110 may either be bidirectional and or multidirectional. The benefit of this configuration is a much more flexible, physically strong and tamper resistant shaft 3110 with much more cross sectional material within its components and along its entire length. This makes the device 3030 more resistant to tampering with brute force.

The shaft 3110 of the device 3030 possesses the displacement region 3110*d* at its proximal terminus which is distally oriented, and may be either conical, pyramidal, cylindrical with a convex terminus, wedge shaped or round shaped. It possesses an indentation 3110*e* at its proximal terminus that avails the shaft 3110 to manipulation with a tool. Its terminus is drawn distally toward the end of the barrel 41 with clockwise turning of key structure 3010 and key 3010*a*. The displacement region 3110*d* on the shaft 3110 penetrates a collet 3150 that possesses a plurality of distally located arms 3150*a*, that are oriented proximally, each with a radially displaceable and proximally located tab 3150*b* that corresponds to similarly shaped slots in the superimposing slotted cylinder 3140. This displacement region 3110*d* resembles a small bushing, with a plurality of near longitudinal cuts beginning on its proximal terminus and proceeding distally. Tabs 3150*b* are radially oriented on its proximal and dorsal surfaces. Material between these tabs 3150*b* may be removed or cut out. The tabs 3150*b* may be chamfered on their distal margins to accommodate firearm forcing cones. The displacement region 3110*d* on the shaft 3110 radially forces the tabs 3150*b* outwardly until secure contact with the firearm's cartridge case rim is made. This collet 3150 may be made of one or more components and possesses a proximally oriented pivotal ability at its distal terminus. The collet 3150 may be fastened in place by a wedge configuration, a crimping means or by mutual threading within the interior of the proximal end of the slotted cylinder 3140. The collet 3150 may possess elastic-like properties as well as a circular spring-like component 3160 located circumferentially over the arms 3150*a*, that is a backup mechanism to assure complete retraction of tabs 3150*b*. Diametrically and circumferentially opposed sets of cams 150 and 160 located at whorls of the original device improved hereby have been eliminated.

It is noted that the cushion 3090*a* and the sleeve 3090*b* in combination all are located at or near crown 45 of the firearm 40 and may be bolstered by additional layers of material used to make the sleeve 3090*b*. It is important to protect the crown as it largely determines the accuracy of the firearm. It is located at the very end of the barrel, where the rifling ends. It is where the exiting bullet has its last physical contact with the barrel and its rifling, as it goes on its way. The cushion 3090*a* and the sleeve 3090*b* in the crown's vicinity increase the protection of this region of the firearm 40. It also stabilizes the device 40 by eliminating gaps, looseness and slippage between the device 3030 and the firearm 40 in this important region. Shim 3085 may also be used to eliminate operational looseness and reduce the risk of mechanical binding within the lock housing 3021 and among its components.

Tabs 3150*b* wedge themselves against inner surface of the firearm chamber 42 proximal of the firearm forcing cone until no further movement of shaft 3110 is possible. At this point, spring loaded-wedge 3051 on annulus 3050 slips on gear 3070. This slippage is audible to the user of the locking device 3030 in the form of a clicking noise. The clicking indicates to the user that the locking procedure is complete. This slip-gear arrangement protects both the firearm 40 and the device 3030 from damage during activation or deactivation of the device as it eliminates excessive torque from damaging the internal components of the device 3030 as well as the interior surfaces of the firearm 40. A fastening, removable and replaceable wedge 3145 is arranged to pass through both the slotted cylinder 3140 and the shaft 3110 simultaneously. The wedge 3145 may be press fitted or otherwise fastened in place. The wedge 3145 enables synchronous movement between the slotted cylinder 3140 and the shaft 3110. It also prevents mechanical binding of the cylinder 3140, the shaft 3110 or both to the tabs 3150*b* on the collet 3150. Additionally, optionally, a second wedge may be used distally to fasten the collet 3150 in place within the proximity of the slotted cylinder 3140.

Once the device 3030 is engaged in the firearm 40, it remains in place in a locked position upon removal of key structure 3010 or key 3010*a*. In an unlocking mode of operation, the device 3030 is unlocked by the re-insertion of key structure 3010 or key 3010*a* through slotted disk 3022 and support disk 3022*a* application of a counter-clockwise rotation. Upon counter-clockwise rotation of lock cam 3024, annulus 3050 rotates in a counter-clockwise direction over gear 3070. Gear 3070 rotates and pushes the threaded distal region 3112 of shaft 3110 through the threaded axial hole 3071 of the gear 3070. Thus, the counter-clockwise rotation of key structure 3010 or key 3010*a* causes shaft 3110 to expand into cylinder 3140 away from the lock housing 3021.

Upon linear movement of shaft 3110 away from lock housing 3021, the displacement region 3110*d* on the shaft 3110 migrates proximally until the tabs 3150*b* on dorsal and distal surfaces of the collet 3150 fully retract back into slotted cylinder 3140 at the urging of the elastic or spring-like properties of the material employed to make the collet 3150 and/or at the urging of the spring 3160. Adjoining the proximal terminus of the shaft 3110 is a compression spring 3120 that is configured to provide enough distally oriented resistance so that no further movement of the shaft 3110 axially is possible. At this point, spring-loaded wedge 3051 on annulus 3050 slips on gear 3070. As during locking, this slippage is audible to the user of the locking device 3030 in the form of a clicking noise. Here, the clicking indicates to the user that the unlocking procedure is complete. Accordingly, the device 3030 is free to be pulled out of the firearm chamber 42 and barrel 41 by the user. Again, this arrangement protects against damage to the device 3030 and the firearm 40 during operation.

An additional element in accordance with this invention is a pyric disk 3080. The pyric disk 3080 is freely rotatable and is located between lock foundation 3090 and proximal disk 3061. The pyric disk 3080 may be comprised of one or more such disks and the location of pyric disk 3080 is chosen to be near the gear 3070, most suitably the section including the threaded distal region 3112 of shaft 3110 on shaft component 3110*a*. The pyric disk 3080 is manufactured of a solder-like material that will melt when exposed to extreme heat as well as friction-related heat generated by cutting with a saw, drilling and grinding. The solder-like material should be a metal that has a melting point at least as high as the temperature commonly attained by blowtorches. The effect is to cause shaft 3110 and other internal components to be seized in place. Gaps between the shaft 3110 and other adjacent components enables molten material of melted pyric disk 3080 to migrate throughout the invention. This design, which allows molten material to migrate into the firearm, may be utilized to further dissuade unauthorized users from tampering with a firearm utilizing such an alternative design of the instant invention. It should be clear that such an alternative design is well within the scope of the present invention. Thus, pyric disk 3080 is designed as a mechanism to protect against tampering via devices such as an acetylene torch.

A compression spring 3120 is shown at the proximal end of shaft section 3110*c* and distal to the chamber plug 3170. Compression spring 3120 places a constant axial force on the shaft 3110 in the direction towards the distal end 12 of the firearm 40. This force is countered by the presence of the lock housing 3010 and the lock mechanism 3020. In the event of tampering which severs the lock mechanism 3020 from the remainder of the device 3020, spring 3120 will maintain tabs 3150*b* on the collet 3150 in a wedged position.

Although the present invention has been described with respect to two specific embodiments, it is to be understood that it is not limited thereto and all equivalents are considered covered by the following claims.

What is claimed is:

1. A device for controlling access to a firearm having a muzzle, the device comprising:

a lock housing and a lock foundation secured together with one or more foundation access screws, wherein the lock housing is arranged to receive a key;

a lock cam arranged for rotation upon rotation of the key positioned in the lock housing;

a cylinder having a plurality of slots, wherein the cylinder is removably attachable to the lock foundation;

a shaft arranged for removable insertion into the muzzle, wherein the shaft includes a displacement region at one end thereof;

a gear engaged with the lock cam and the shaft such that rotation of the lock cam causes rotation of the gear in a manner that draws the shaft into the cylinder; and a collet between the cylinder and the shaft, the collet having a plurality of arms and one or more radially displaceable tabs arranged on the plurality of arms for insertion in the slots of the cylinder when the shaft moves through the collet into the cylinder.

2. The device of claim 1 further comprising an annulus and a plurality of spring-loaded wedges engaged with the gear and rotationally fixed to the lock cam such that rotation of the lock cam causes rotation of the annulus and thereby rotation of the gear.

3. The device of claim 1 further comprising a pair of protective disks on opposing sides of the gear and arranged to reduce the effect of tampering by crushing.

4. The device of claim 1 wherein the lock housing and the lock foundation are arranged to accept and shelter the muzzle of the firearm.

5. The device of claim 1 further comprising a cushion positioned on at least a portion of the lock foundation to cover and protect and minimize slippage of a union of the lock foundation and the muzzle of the firearm.

6. The device of claim 5 wherein the cushion establishes a shelter in either a generic form adaptable to any firearm or a model specific form for specific firearms.

7. The device of claim 5 further comprising a sleeve that in combination with the cushion is arranged to protect a crown of the firearm.

8. The device of claim 1 wherein the cross sectional shape of the lock housing and the lock foundation are selectable to conform to dimensions of the firearm.

9. The device of claim 1 further comprising a rotatable chamber plug arranged for engagement with the cylinder.

10. The device of claim 1 further comprising a rotatable protective bushing arranged to protect components of the device located in the lock housing.

11. The device of claim 10 further comprising a collection of pins and disks that in combination with the protective bushing establish a cage-like structure to protect components of the device located in the lock housing.

12. The device of claim 1 further comprising a pyric disk located near the gear.

13. A device for controlling access to a firearm having a muzzle, the device comprising:

a lock housing and a lock foundation secured together with one or more foundation access screws, wherein the lock housing is arranged to receive a key;

a lock cam arranged for rotation upon rotation of the key positioned in the lock housing;

a flexible cylinder having a plurality of slots, wherein the cylinder is removably attachable to the lock foundation;

a flexible shaft arranged for removable insertion into the muzzle, wherein the flexible shaft includes a displacement region at one end thereof;

a gear engaged with the lock cam and the flexible shaft such that rotation of the lock cam causes rotation of the gear in a manner that draws the flexible shaft into the flexible cylinder; and a collet between the flexible cylinder and the flexible shaft, the collet having a plurality of arms and one or more radially displaceable tabs arranged on the plurality of arms for insertion in the slots of the flexible cylinder when the flexible shaft moves through the collet into the flexible cylinder.

14. The device of claim 13 further comprising an annulus and a plurality of spring-loaded wedges engaged with the gear and rotationally fixed to the lock cam such that rotation of the lock cam causes rotation of the annulus and thereby rotation of the gear.

15. The device of claim 13 wherein the flexible cylinder is formed of a non-metallic material or braided steel tubing.

16. The device of claim 15 further comprising a plastic tubing over the flexible cylinder.

17. The device of claim 13 wherein the flexible shaft is an articulating shaft formed of a plurality of interconnected components.

18. The device of claim 17 wherein a first section of the shaft is coupled to the gear and a second section of the flexible shaft further includes a plurality of slots arranged to enable pivotal movement of the flexible shaft.

19. The device of claim 18 wherein the second section of the flexible shaft has either a spherical terminus or a post-like structure with a globular terminus.

20. The device of claim 13 wherein the lock housing and the lock foundation are arranged to accept and shelter the muzzle of the firearm.

21. The device of claim 13 further comprising a cushion positioned on at least a portion of the lock foundation to cover and protect and minimize slippage of a union of the lock foundation and the muzzle of the firearm.

22. The device of claim 21 wherein the cushion establishes a shelter in either a generic form adaptable to any firearm or a model specific form for specific firearms.

23. The device of claim 21 further comprising a sleeve that in combination with the cushion is arranged to protect a crown of the firearm.

24. The device of claim 13 wherein the cross sectional shape of the lock housing and the lock foundation are selectable to conform to dimensions of the firearm.

25. The device of claim 13 further comprising a rotatable chamber plug arranged for engagement with the flexible cylinder.

26. The device of claim 13 further comprising a rotatable protective bushing arranged to protect components of the device located in the lock housing.

27. The device of claim 26 further comprising a collection of pins and disks that in combination with the protective bushing establish a cage-like structure to protect components of the device located in the lock housing.

28. The device of claim 13 further comprising a pyric disk located near the gear.

* * * * *